US008251384B1

(12) United States Patent
Christensen et al.

(10) Patent No.: US 8,251,384 B1
(45) Date of Patent: Aug. 28, 2012

(54) AXLE AND SUSPENSION

(75) Inventors: Mark A. Christensen, Salt Lake City, UT (US); George F. McHugh, III, Salt Lake City, UT (US)

(73) Assignee: Other Planet Products, Inc., Salt Lake City ( * ) Notice: Subject to any disclaimer, the term of this patent is extended or adjusted under 35 U.S.C. 154(b) by 361 days.

(21) Appl. No.: 12/590,544

(22) Filed: Nov. 10, 2009

Related U.S. Application Data

(60) Provisional application No. 61/113,829, filed on Nov. 12, 2008.

(51) Int. Cl.
*B62M 1/00* (2010.01)

(52) U.S. Cl. ..... 280/87.042; 280/11.115

(58) Field of Classification Search ..... 280/11.115, 280/87.042, 221, 11.27, 11.28, 124.103
See application file for complete search history.

(56) References Cited

U.S. PATENT DOCUMENTS

| | | | | |
|---|---|---|---|---|
| 244,372 | A | 7/1881 | Bliss | |
| 317,601 | A | 5/1885 | Burton et al. | |
| 319,839 | A | 6/1885 | Nelson | |
| 329,556 | A | 11/1885 | Hirt | |
| 921,102 | A | 5/1909 | Grout | |
| 1,387,091 | A | 8/1921 | Wooley et al. | |
| 1,550,985 | A | 8/1925 | Schluesselburg | |
| 2,330,147 | A | 9/1943 | Rodriguez | |
| 3,331,612 | A | 7/1967 | Tietge | |
| 4,054,297 | A * | 10/1977 | Solimine | 280/87.042 |
| 4,060,253 | A | 11/1977 | Oldendorf | |
| 4,645,223 | A | 2/1987 | Grossman | |
| 5,263,725 | A | 11/1993 | Gesmer et al. | |
| 5,280,935 | A * | 1/1994 | Sobocan | 280/221 |
| 5,330,214 | A * | 7/1994 | Brooks et al. | 280/87.042 |
| 5,794,955 | A * | 8/1998 | Flynn | 280/87.042 |
| 5,971,411 | A | 10/1999 | Jones et al. | |
| 5,997,018 | A * | 12/1999 | Lee | 280/87.042 |
| 6,158,752 | A * | 12/2000 | Kay | 280/87.042 |
| 7,374,179 | B2 * | 5/2008 | Cole | 280/11.27 |
| 7,635,136 | B2 * | 12/2009 | Cole | 280/87.042 |
| 7,744,100 | B2 * | 6/2010 | Cole | 280/11.115 |
| 2005/0012290 | A1 * | 1/2005 | McClain | 280/87.042 |

* cited by examiner

*Primary Examiner* — Hau Phan
(74) *Attorney, Agent, or Firm* — Brian C. Trask

(57) ABSTRACT

An improved skateboard truck in which a curved support surface is configured to make line contact that sweeps back and forth along a working surface associated with a truck's axle as the axle oscillates through a cycle including left-turn and right-turn orientations. The axle pivots around the locus of line contact during at least a portion of the cycle. From a frame of reference associated with the support surface, the lines of contact are parallel at max-left and max-right turn configurations. Preferred embodiments include structure arranged to resist departure from a zero-turn configuration while permitting micro-turn adjustment. Structure may be included to limit the range of rolling rotation of the deck about its length axis.

23 Claims, 9 Drawing Sheets

AXLE AND SUSPENSION

RELATED APPLICATIONS

This application claims the benefit under 35 U.S.C. 119(e) of the filing date of Provisional Application Ser. No. 61/113,829, filed Nov. 12, 2008, for "SKATEBOARD TRUCK".

BACKGROUND

1. Field of the Invention

This invention relates to steerable conveyances. Certain preferred embodiments are particularly adapted for use in skateboarding.

2. State of the Art

Conveyances that are steerable by leaning or tipping the vehicle body have been available for a number of years. Early embodiments illustrated in U.S. Pat. Nos. 2,44,372 to Bliss; 317,50 to Burton et al.; and 319,839 to Nelson applied the concept of an angled pivot axis to roller skates. As a consequence of the angle of the pivot axis, when the axle rotates with respect to a local coordinate system and about the pivot axis, the axle turns to steer the skates with respect to a global coordinate system. A cogent discussion of the effect of structural arrangements on turning capability of a skateboard is presented in U.S. Pat. No. 4,060,253 to Oldendorf.

In embodiments structured according to the foregoing patent disclosures, a force applied normal to a conveyance platform and along the platform centerline length axis, when the platform is rotated to a maximum turn configuration, fails to cause a return moment effective to urge the conveyance toward a no-turn configuration. That is because the applied force acts directly through the pivot axis, and consequently, has no moment arm. However, a return moment is caused by the compressed rubber suspension components, or spring elements.

Sometimes, it is advantageous for a suspension system to initially resist departure of the axle from a zero-turn configuration that promotes straight-line travel of the conveyance. Such a suspension system may advantageously reduce wobble and thereby promote stability of the conveyance in traveling in an approximately straight line at higher speeds. One such suspension system includes the spring-loaded cam centering arrangement disclosed by Hirt in U.S. Pat. No. 329,556.

An evolution in suspension configurations employing rubber cushion elements is illustrated in combination by U.S. Pat. No. 921,102 to Grout; U.S. Pat. No. 1,550,985 to Schluesselburg; U.S. Pat. No. 3,331,612 to Tietge; and U.S. Pat. No. 4,645,223 to Grossman. An alternative suspension arrangement is illustrated in U.S. Pat. No. 5,263,725 to Gesmer et al., in which is disclosed a suspension configured to avoid damping rubber elements.

In U.S. Pat. No. 1,387,091, Woolley et al. disclose a child's coaster having a support surface arranged to rock along an axle to cause steerable movement of their axle. The load-bearing contact between the axle and support surface is point-contact, and the contact point makes an arcuate path along the support surface. In U.S. Pat. No. 2,330,147, Rodriguez discloses a scooter suspension including a moving pivot axis location, about which axis the scooter body instantaneously rotates. Rodriguez's pivot axis is displaced in a length direction of the axle during a turn. The load-bearing contact at the pivot axis location is disposed between a sliding foot 23 and a support surface of bottom truck 13. Contact between the sliding foot 23 and the support surface of truck 13 during a turn is inherently sliding contact due to the interaction of pin 14 in slot 21, and the radii of foot 23. In U.S. Pat. No. 5,971,411, Jones et al. disclose an axle trapped between parallel walls to permit substantially planar oscillation of the axle relative to the walls. Their axle pivots about a single axis caused by pin 16. The resulting axis of axle rotation is spaced'apart from a contact between the axle 12 and the axle-supporting surface of cushion 13. Therefore, as the axle 12 rotates about the pivot location, the axle inherently scrubs in sliding contact with respect to the axle-supporting surface of cushion 13. A load applied perpendicular to the skateboard deck, at the mid-deck centerline, acts through the pivot axis, and fails to generate a return moment effective to urge the device to a zero-turn configuration.

Each and every one of the aforementioned U.S. patent documents is hereby incorporated into this document in their entirety by this reference for their disclosures of structure related to steerable conveyances. It would be an improvement to provide an axle and suspension system that provides enhanced operational characteristics.

BRIEF SUMMARY OF THE INVENTION

This invention provides an apparatus that may be steered by a rider by way of rolling, or leaning, a rider-supporting surface of the apparatus with respect to the ground. Embodiments of the apparatus generally include an axle, mounting structure effective to couple the axle to the conveyance, and a support surface that contacts a working surface associated with the axle. A preferred support surface has an area with a profile configured and arranged to variably contact the working surface as the axle oscillates, such that a location of a theoretical pivot axis, about which axis the axle instantaneously rotates with respect to the mounting structure is disposed at a locus of substantially line contact between the support surface and the working surface during a portion of an axle oscillation cycle. Also, the theoretical pivot axis is displaced back and forth in a direction parallel to a length axis of the axle during an axle oscillation cycle. Furthermore, from a frame of reference associated with the support surface, the instantaneous theoretical pivot axis disposed at a max-right turn configuration is parallel to the theoretical pivot axis disposed at a max-left turn configuration.

Desirably, a portion of the mounting structure is configured and arranged to permit oscillation of the axle in substantially a single plane. Typically, the location of the theoretical pivot axis is displaced in the axle length axis direction by an increasingly larger amount as the axle oscillates from a midrange turn configuration toward a maximum turn configuration. In certain embodiments, the support surface and the working surface are cooperatively configured such that contact there-between during a portion of an axle oscillation is substantially pure rolling contact. Certain embodiments are structured such that, during conventional use, more than one-half of the total load carried by the axle is applied by the support surface to said axle by contact there-between, the contact being disposed substantially at the pivot axis location.

One operable mounting structure includes a planar front wall portion and a planar rear wall portion disposed parallel to, and spaced apart from, the front wall portion sufficiently to receive a portion of the axle there-between. Generally, a steering angle formed between a plane disposed parallel to the front wall portion and a plane perpendicular to a transport surface is between about 5 degrees and about 50 degrees. In more preferred embodiments, the steering angle is between about 15 degrees and about 30 degrees.

In certain preferred embodiments, the theoretical pivot axis is disposed substantially perpendicular to the front wall portion at a zero-turn configuration of the apparatus. Sometimes, the theoretical pivot axis is substantially perpendicular to the front wall portion at both of the max-left turn configuration and the max-right turn configuration.

One workable support surface includes a portion of a cam having a left turn profile, a right turn profile, and a neutral zone disposed there-between, the neutral zone being associated with a zero-turn configuration. Sometimes, the neutral zone is structured in harmony with the working surface effective to provide initial resistance to oscillation of the axle away from the zero-turn configuration. In certain cases, the neutral zone includes structure configured to simultaneously contact the working surface at two locations that are spaced apart along the length axis of the axle. In one preferred embodiment, one of the left turn profile and the right turn profile comprises an arcuate surface. A portion of that arcuate surface may be defined by a radius having a length of between about 1½ inches and about 3½ inches. Sometimes, the radius has a constant value over a transverse length of the arcuate surface.

The axle may be maintained in trapped registration with respect to mounting structure by a pin member that is anchored with respect to at least one of a front wall portion and a rear wall portion and has a portion disposed in sliding registration inside an elongate slot carried by the axle. The pin member and the elongate slot can be cooperatively arranged to resist axle oscillation beyond a desired maximum value. In certain embodiments, the axle is maintained in trapped registration with respect to mounting structure by confinement of a support cam inside a cage. The cam and cage can be cooperatively configured and arranged to resist axle oscillation beyond a desired maximum value.

The invention may be embodied to provide a skateboard truck of the type adapted to anchor an axle carrying a pair of wheels in operable association with a skateboard deck and effective to cause steerable movement of the axle responsive to rotation of the deck about a deck length-axis, the truck including a suspension arrangement configured to resist relative oscillation of axle in an out-of-plane direction and to permit in-plane oscillation of the axle within a desired range. An improvement provided by the invention includes a suspension arrangement being configured and arranged such that a force applied normal to the deck and along a mid-deck length axis, when the deck is rotated to a maximum turn configuration, causes a return moment effective to urge the deck toward a no-turn configuration. A further improvement includes the suspension arrangement being configured and arranged such that displacement, from a mid-range turn configuration toward a max-turn configuration, causes substantially pure rolling line contact to be formed between a load-bearing surface associated with the axle and a load-supporting surface that may be anchored with respect to a deck of the skateboard.

BRIEF DESCRIPTION OF THE DRAWINGS

In the drawings, which illustrate what are currently considered to be the best modes for carrying out the invention.

DETAILED DESCRIPTION OF THE ILLUSTRATED EMBODIMENTS

Reference will now be made to the drawings in which the various elements of the illustrated embodiments will be given numerical designations and in which the invention will be discussed so as to enable one skilled in the art to make and use the invention. It is to be understood that the following description is only exemplary of the principles of the present invention, and should not be viewed as narrowing the claims which follow.

For purpose of this disclosure, the term "oscillation", along with related conjugations and derivatives thereof, may be defined in partial accordance with its dictionary meaning as "to move or swing back and forth", but not necessarily at any regular rate. In particular, rate of oscillation of an axle is generally dependent on a user's input. A complete axle oscillation cycle may be defined as displacing an axle from a zero-turn configuration to a max-left turn configuration, then to a max-right turn configuration and finally, back to the zero-turn configuration. A return moment is defined as that moment effective to return an axle from a turn configuration toward a no-turn configuration.

For purpose of explaining operational characteristics of embodiments structured according to certain principles of the invention, and for distinguishing over certain prior art, theoretical limiting cases are sometimes employed as exemplary yardsticks. For a first example, line contact will be used to characterize compression contact between selected components of embodiments structured according to certain principles of the instant invention. Of course, it is recognized that real-world components deflect under compression to a certain degree, resulting in "patch" contact over an area disposed at the locus of contact.

For a second example, the line of action of a force applied at a conventional and commercially available skateboard deck's centerline acts, in theory, through the pivot axis of the skateboard's truck, regardless of turn angle. In fine detail, it is recognized that components may deflect, thereby providing a tiny moment arm. Regardless, the resulting return moment generated by the applied force is believed to be negligible, and can safely be ignored in explaining the fundamental operation of such structures. The entire return moment is essentially caused by only the compressed rubber suspension components, and/or spring elements. Therefore, it is believed that one of ordinary skill in the art will appreciate that the selected theoretical yardsticks used in this document reasonably characterize the true behavior of the characterized components.

Figure 1:
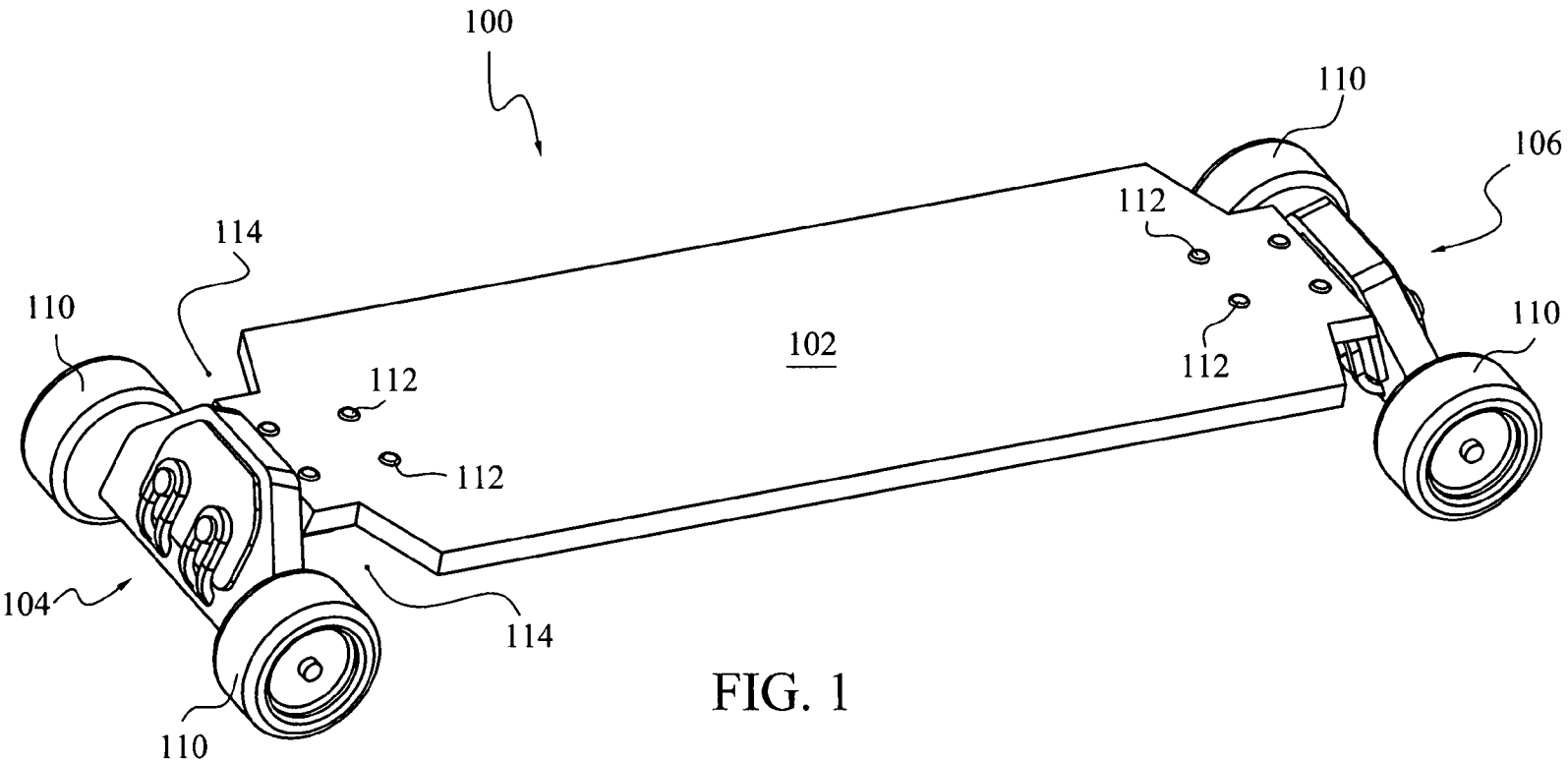
FIG. 1 is a view from above, in perspective, of a first embodiment structured according to certain principles of the invention and installed on a skateboard.

A first embodiment of a skateboard structured according to certain principles of the instant invention is illustrated in FIG. 1, generally at 100. Skateboard 100 includes a deck 102, on which a rider stands. Front truck assembly, generally 104, and rear truck assembly, generally 106, are configured to steer wheels 110 as the rider leans the deck 102 to cause the skateboard to turn. When the rider leans the deck, the deck essentially rotates about a deck length axis.

Truck assemblies 104 and 106 may be mounted to deck 102 using conventional fasteners 112, such as nuts and bolts. As perhaps best illustrated in FIG. 1, truck assemblies 104 and 106 are mounted at respective ends of the deck 102 to permit a portion of a truck to "ride up" in elevation with respect to the top surface of deck 102. Such an arrangement advantageously lowers the rider's contact interface on the skateboard deck. Wheel wells 114 are typically provided to permit clearance between the wheels 110 and deck 10 as an edge of deck 102 is forced downward by a rider during a turn.

Figure 2:
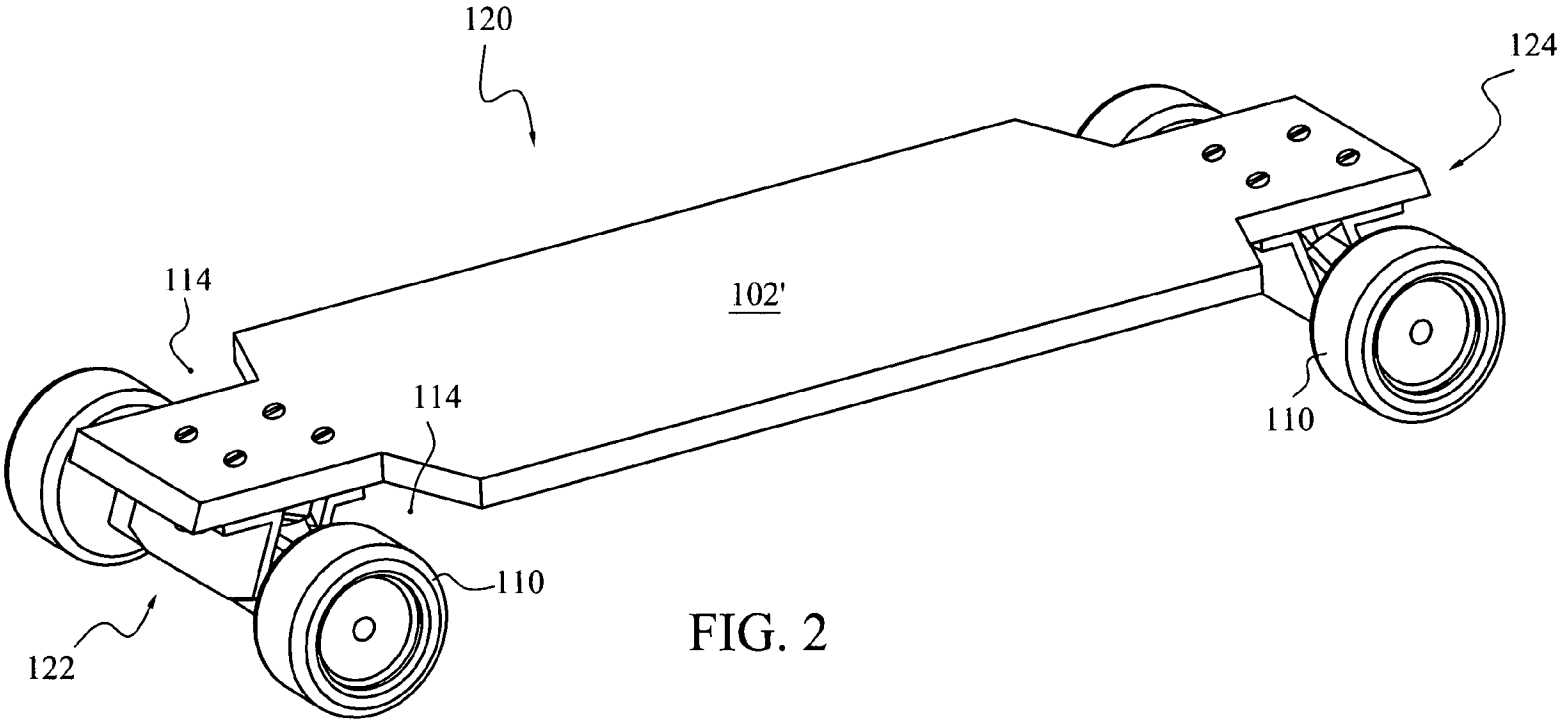
FIG. 2 is a view from above, in perspective, of a second embodiment structured according to certain principles of the invention and installed on a skateboard.

A second embodiment of a skateboard structured according to certain principles of the instant invention is illustrated in FIG. 2, generally at 120. Again, front truck assembly, generally 122, and rear truck assembly, generally 124, are configured to steer wheels 110 as the rider leans the deck 102' to cause the skateboard to turn. Front truck assembly 122 and rear truck assembly 124 are configured for mounting under a deck in substantially conventional fashion. In most cases, it is preferred to again provide wheel wells 114, to generally minimize the elevation of a rider's contact interface and to permit significant deck rotation.

The various truck assemblies can be mix-and-matched, if desired. That is, it is within contemplation that a front truck assembly 104 may be assembled to a deck in combination with a rear truck assembly 124. Further, a front truck assembly 122 may be assembled to a deck in combination with a rear truck assembly 106. There is not necessarily a front and back orientation for a skateboard, and such terminology has been used in this document simply as a convenience. In certain cases, the "front" direction for travel on a skateboard structured according to certain principles of the instant invention may selected arbitrarily.

Truck assemblies 104 and 106 may be identical to one-another, or may be structured to provide a particular steering arrangement for a skateboard 100, as desired. Similarly, assemblies 122 and 124 may be identical to one-another, or may be structured to provide a particular steering arrangement for a skateboard 120, as desired. That is, in some cases, a front truck assembly may be configured to provide a sharper turning radius than a rear truck assembly, or vice-versa. Paired truck assemblies having identical turning radii may promote a rider sensation of carving a turn. Such turn carving is similar to riding the edge of a snowboard during a turn, instead of skidding, or slipping the edge with respect to the snowpack.

Details of construction of a truck assembly of the type installed on skateboard 100 will now be described with reference to FIGS. 3 through 6. As a convenience, front truck assembly 104 will now be described with reference to its orientation as a "front" truck assembly, but with the understanding that terms "front" and "rear" may be interchangeable.

Truck assembly 104 includes a hanger 128, which carries axle 130 in steerable relation to the anchor flange 132. Anchor flange 132 is typically affixed to a deck 102 by way of conventional fasteners, such as bolts and nuts, wood screws, rivets, and the like. A deck 102 is typically received in the space 134 on top of anchor flange 132. Desirably, the deck is spaced sufficiently apart from contact with movable portions of the truck assembly 104 as to permit substantially unrestricted relative motion there-between as the hanger 128 "rides-up" during a turn. The hanger 128 is trapped between parallel walls formed by downward projecting leg 136 of anchor flange 132, and cover 138. Desirably, a sliding fit is arranged between such walls to permit oscillating motion of the hanger 128 and axle 130, and to provide a smooth turning action. Sometimes, lubrication may be applied to the sliding area.

Figure 6:
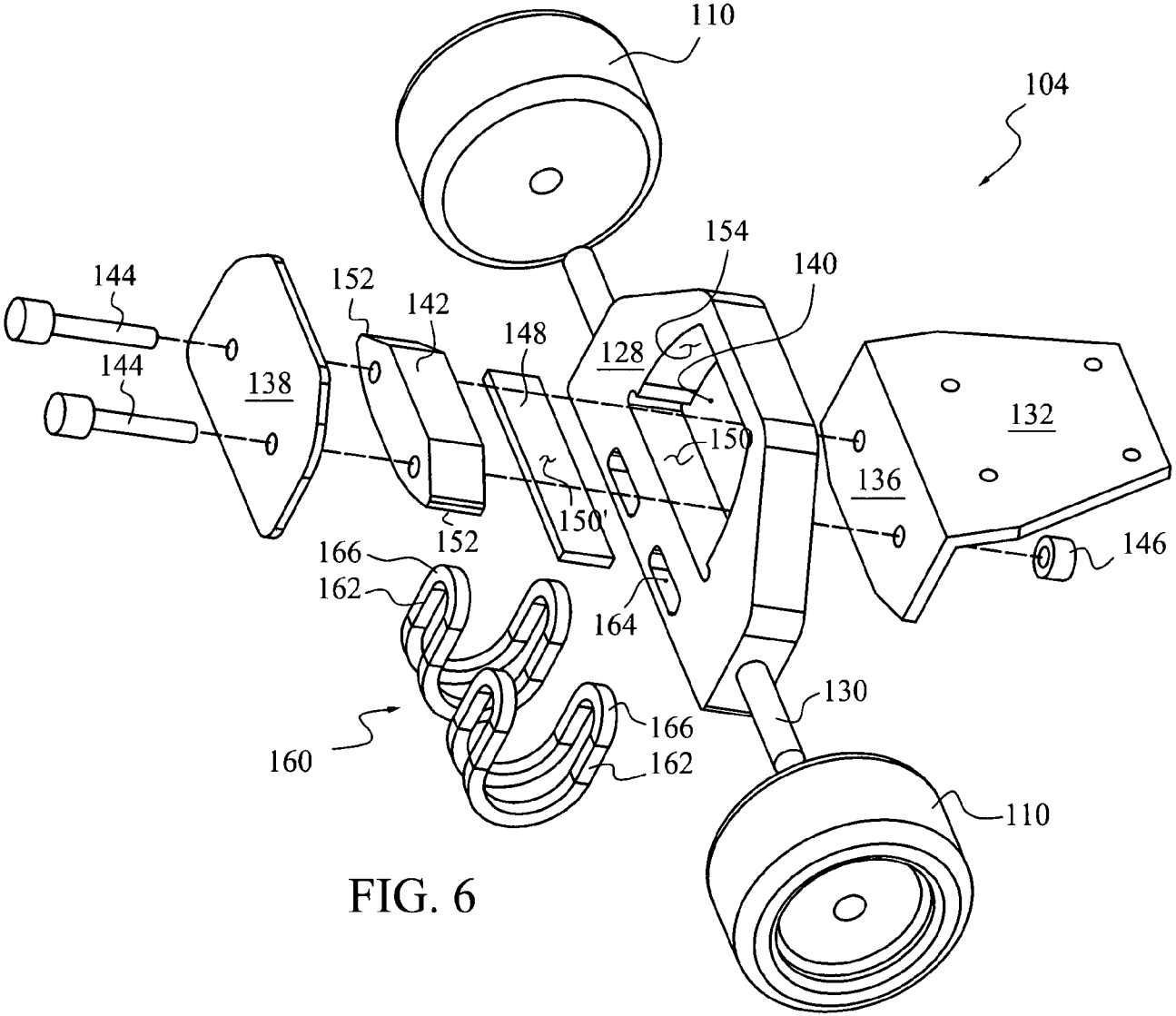
FIG. 6 is an exploded assembly view in perspective from above of the embodiment of FIG. 1.

With particular reference to FIG. 6, hanger 128 provides an opening, or cage 140, in which is received cooperatingly structured cam 142. A cage 140 may have any configuration that retains the cam 142, and permits desired axle oscillation. As illustrated, oppositely disposed noses 152 are structured to engage surface 154 of cage 140 to resist transverse displacement of the axle 130 with respect to the surface 154. By retaining the cam 142, it follows that the cage 140 holds the axle 130 in a steerable association with the anchor flange 132. Rotation of deck 102 therefore causes axle 130 to steeringly oscillate with respect to the deck 102. Desirably, a cage 140 is structured and arranged to provide a limit to the maximum extent of oscillation of cam 142 with respect to the axle 130. However, it is within contemplation that other structure may be arranged to limit steering oscillation.

Cam 142 is typically squashed in compression between cover 138 and leg 136 upon assembly of retainer bolts 144 and nuts 146. In the illustrated embodiment, the cam 142 is sized slightly more thick than the cooperating thickness of hanger 128, to provide a slip-fit effective to permit smooth oscillation of the hanger 128 and axle 130. In certain embodiments, and as illustrated, a resilient element 148, or meniscus, may be installed between cam 142 and the floor of cage 140. It is within contemplation to form a hanger 128 and/or cam 142 to include a certain amount of resilience as an alternative to, or in addition to, the meniscus 148. As discussed further below, it is generally desirable for the support surface of the cam 142 to engage in rolling contact with the working surface 150 of the hanger 128, or with a working surface otherwise associated with axle 130 (such as the contact surface of meniscus 148 that loads working surface of cam 142, if the meniscus 148 is present).

Sometimes, and as illustrated, it is desirable to include a self-biased spring arrangement effective to urge the axle 130 toward a neutral position with respect to cage 140, or toward a zero-turn configuration. One exemplary spring arrangement, generally 160, includes a pair of tension spring elements 162 that are received through hanger slots 164 to dispose loop-ends 166 in anchored association with structure associated with bolt 144 and nut 146. Additional retaining structure, such as a washer, may be provided to robustly trap a loop-end 166 in an installed position. An illustrated spring element 160 is formed by an elastomeric O-ring, although conventional tension springs are also workable. Spring elements may be installed to place their effective line-of-action at any desired workable location.

Figure 7:
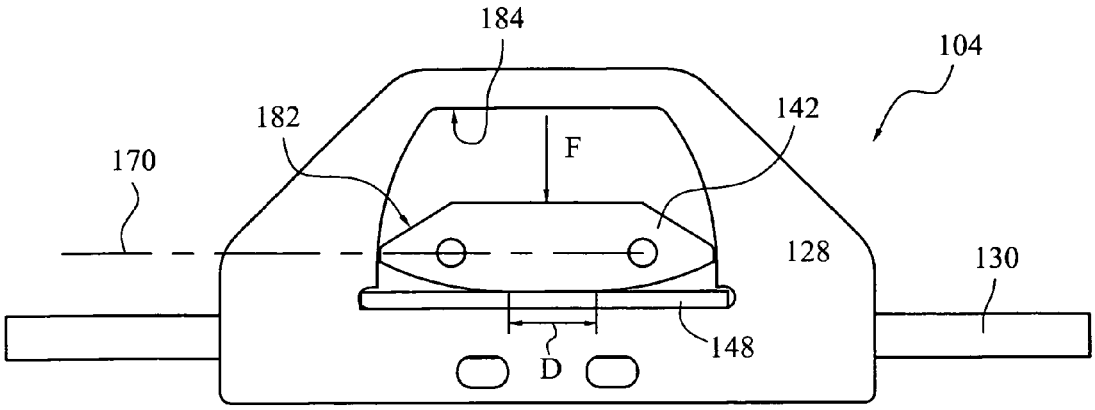
FIG. 7 is a front view in elevation of certain working components of the embodiment of FIG. 1, illustrated in a zero-turn configuration.
Figure 8:
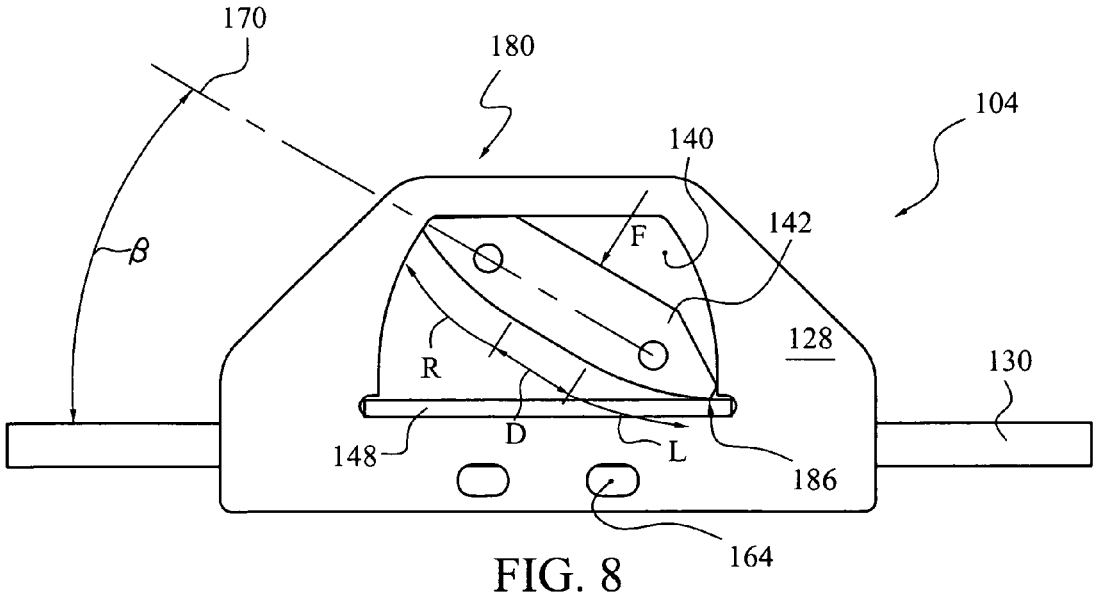
FIG. 8 is a front view in elevation of certain working components of the embodiment of FIG. 1, illustrated in a max-left turn configuration.
Figure 9:
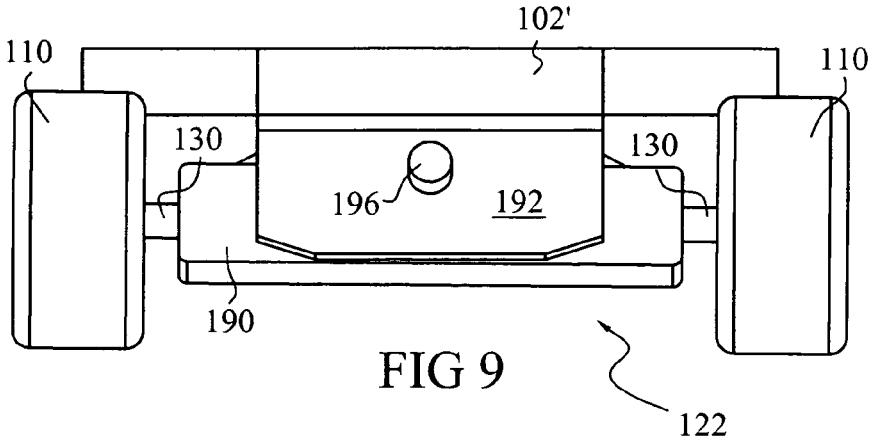
FIG. 9 is a front view in elevation of the embodiment illustrated in FIG. 2.
Figure 10:
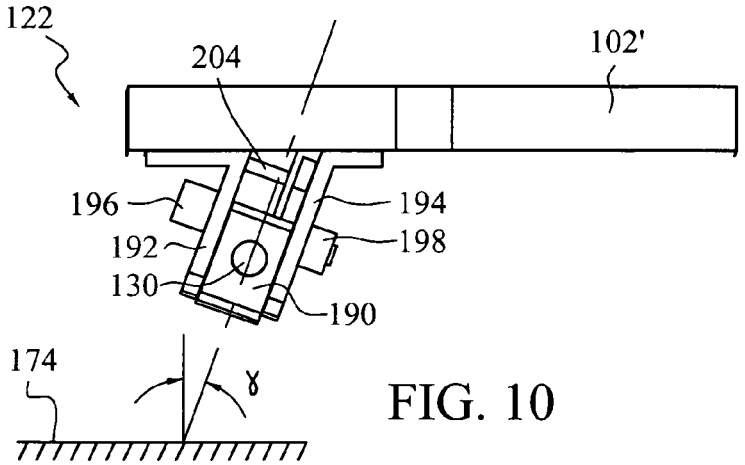
FIG. 10 is a side view in elevation of the embodiment illustrated in FIG. 2, but with the wheels removed.
Figure 11:
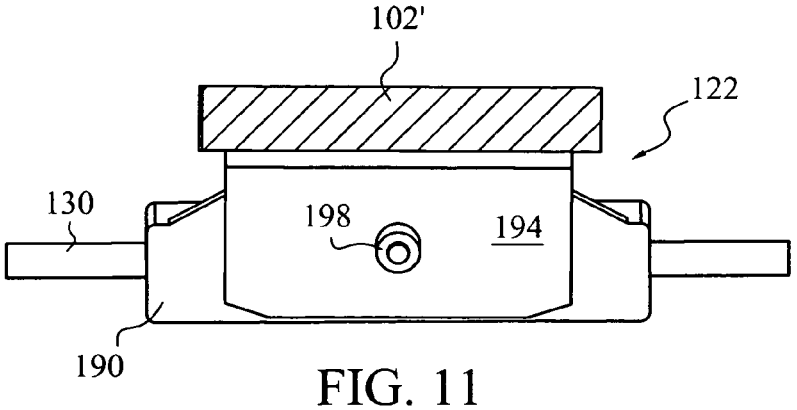
FIG. 11 is a rear view in elevation of the embodiment illustrated in FIG. 2, but with the wheels removed.
Figure 12:
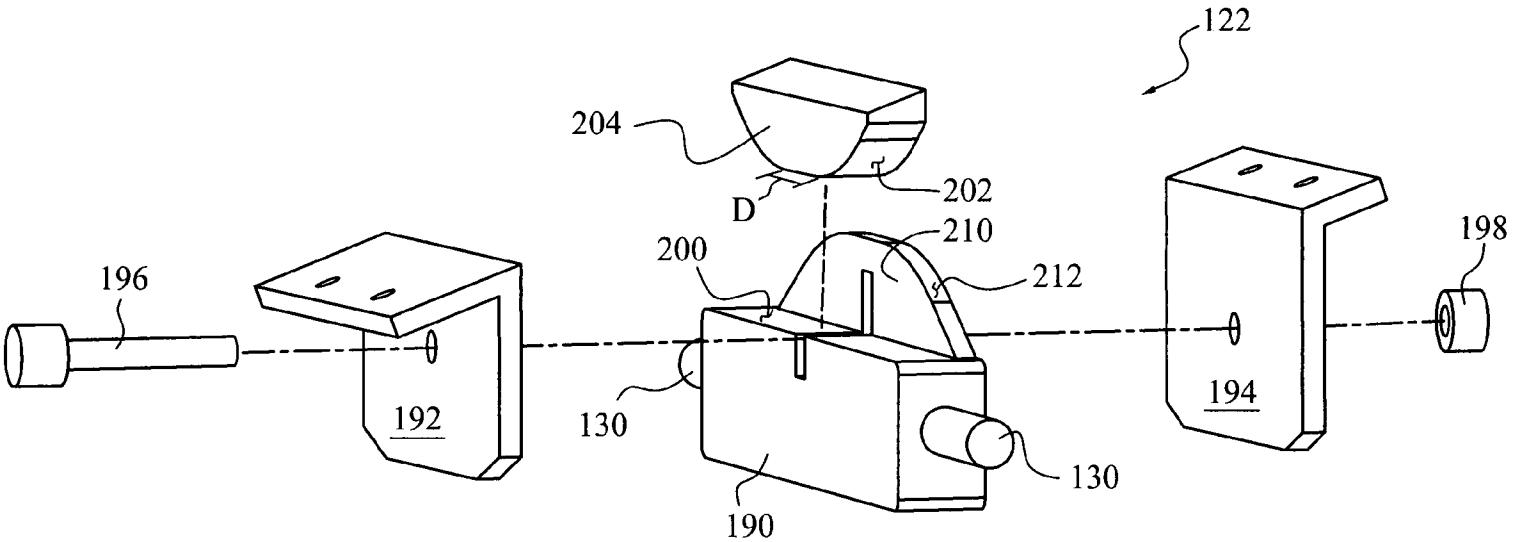
FIG. 12 is an exploded assembly view in perspective from above of the embodiment of FIG. 2.

With reference now to FIGS. 7 and 8, interaction between illustrated exemplary cam 142 and cage 140 will now be further discussed. In the zero-turn configuration illustrated in FIG. 7, an orientation axis 170 of cam 142 is disposed parallel to the length axis of axle 130 and to the top surface of deck 102. A flat spot of illustrated cam 142 is indicated having length D, and forms a sweet spot, or neutral zone, promoting a stable zero-turn configuration to permit riding a skateboard 100 a fairly fast rate of travel while traveling in a substantially straight line.

Force vector F is representative of the rider's effective applied force applied along the length axis centerline of deck 102. In FIG. 7, the force vector F is basically the rider's weight under the effect of gravity. It can be visualized that the rider has to apply an effective force vector F at a location outboard of the flat spot D in order to rotate the deck 102 and initiate an oscillation of hanger 128 and therefore axle 130. Put another way, the neutral zone is desirably structured in harmony with the working surface 150' effective to provide initial resistance to oscillation of axle 130 away from the zero-turn configuration illustrated in FIG. 7.

It is generally preferred for the neutral zone length D to have a value between about 0.5 inches and about 1.5 inches for use in a skateboard 100, although the size of length D may be manufactured as desired for an individual rider's preference. A currently preferred length D is between about 0.7 inches and about 1 inch. Of course, the sweet spot structure does not have to be a flat surface. An equivalent sweet spot length D may be formed by alternate structure arranged to contact a working surface, such as meniscus 148, at two locations that are spaced apart along a length axis of axle 130. Some riders may not care for the sweet spot length D to be included; at all. In any case, it is desirable to provide a certain resilience in the system to permit a rider to make micro-steering adjustments while riding in a substantially straight line.

The meniscus-contacting surface (or the support surface) of cam 142 includes a right curving profile indicated by arrow "R" in FIG. 8, and a cooperating left curving profile indicated by the arrow "L". As perhaps best illustrated in FIG. 6, a working surface 150' is associated with axle 130, and is arranged to cooperate with, and to contact the support surface of, cam 142. Of note, although it is more simple, a working surface such as 150' does not have to be substantially flat, so long as it is cooperatively shaped to operate with a support surface. Currently it is desirable to provide a constant thickness, indicated at "T" in FIG. 4, of the support surface and a working surface such as 150 (or 150' when meniscus 148 is present). In one workable embodiment, the thickness T is about ¾ of an inch. Contact between the support and working surfaces can be characterized as line-contact when the truck assembly's hanger 128 is oscillated to place contact between one of right- and left-curving profiles and the support surface.

The curved profiles R and L are typically, but not necessarily, symmetrical about a centerline, or vertical mid-plane, of cam 142. For example, certain riders may desire a more rapid turn-rate when turning in one direction compared to the other. In such case, the desired sharper-turning side would have a profile including a more pronounced curvature. One desirable support surface may be formed by a simple radius having a length between about 1 and 3 inches, or so. The flat spot length D may then be essentially removed from the curved material, if desired. It is within contemplation for the support surface of a cam 142 to have a curvature profile including a compound curvature. It is further within contemplation to provide interchangeable and differently structured cam elements 142 to permit a rider to modify the turning characteristics of his/her truck assembly.

Figure 4:
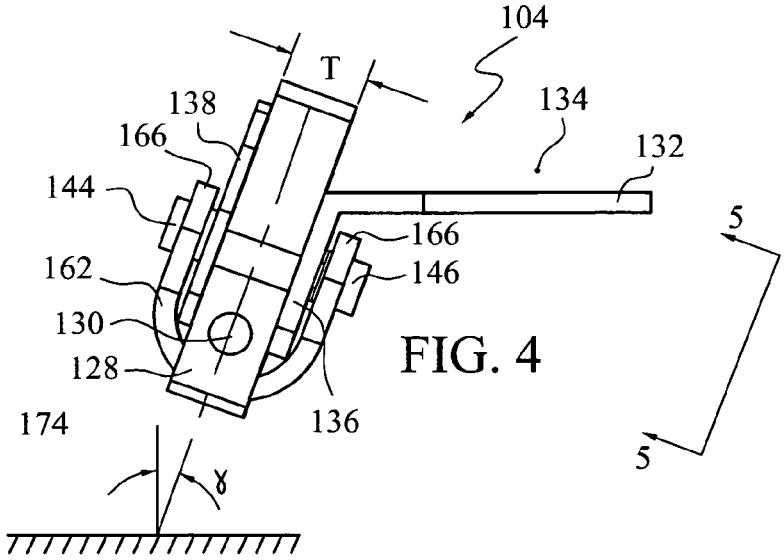
FIG. 4 is a side view in elevation of the embodiment illustrated in FIG. 1, but with the wheels removed.
Figure 5:
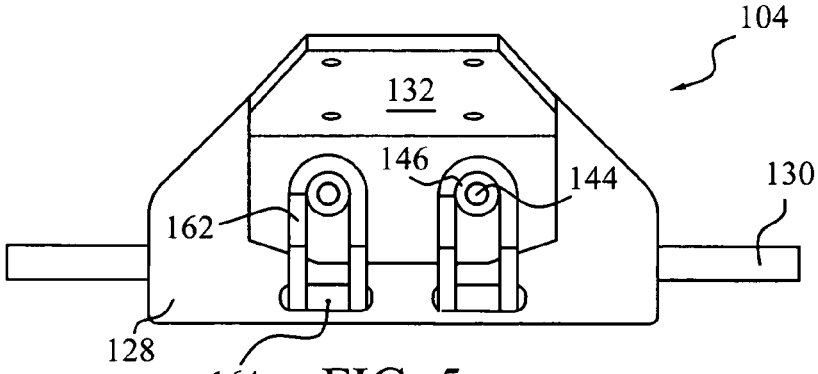
FIG. 5 is a rear view in elevation of the embodiment illustrated in FIG. 1, but with the wheels and deck removed.

The curved profiles R and L cause relative steering of axle 130 compared to a deck 102 when the rider leans, or rotates, the deck 102 by permitting a rider to oscillate the axle 130 in a plane with respect to the anchor flange 132 (and therefore with respect to the deck 102). The amount of effective turn angle for the illustrated skateboard 100 is a function of the amount of deck rotation β (FIG. 8) and the steering angle γ (FIG. 4). As illustrated, the steering angle γ is defined as the angle between a normal to transport surface 174 and a plane parallel to leg 136 of anchor flange 132 when the skateboard 100 is at a zero-turn configuration. A maximum amount of skateboard turn for a given amount of deck roll may be provided by a steering angle γ of 45 degrees. It is typically preferred for the steering angle γ to be between about 10 to about 30 degrees, although other steeper and more shallow angles are workable. A currently preferred range for steering angle γ is between about 15 to 20 degrees, with corresponding curved profiles R and L being defined by a radius having a value of about 2½ inches.

It is generally desirable to limit the maximum amount of deck roll 3 to resist permitting contact with the edge of deck 102 and the transport surface 174 during a turn. Such ground-to-board contact can cause a skateboard to slip out from under a rider, with an attendant loss of steering control, and an ensuing wipe-out. A currently preferred maximum deck rotation β is perhaps 30 to 32 degrees, although some riders may prefer even more deck roll than 32 degrees. With reference still to FIGS. 7 and 8, one exemplary roll-limiting arrangement is indicated generally at 180. Roll-limiting structure 180 includes surface 182 that is arranged to contact surface 184 at a maximum left turn orientation of hanger 128 with respect to support cam 142.

At the max-left turn orientation illustrated in FIG. 8, the support surface of cam 142 is pivoting on surface 150' at the location of theoretical line contact indicated at 186. Line contact 186 is a theoretical pivot axis, about which axis the axle 130 instantaneously rotates with respect to anchor flange 132. The pivot axis is disposed at a locus of substantially line contact between support surface of cam 142 and working surface 150' during a portion of an axle oscillation cycle. The theoretical pivot axis 186 is also displaced back and forth in a direction parallel to a length axis of axle 130 during an axle oscillation cycle. Desirably, the cam support surface of a cam, such as cam 142, and a working surface associated with an axle 130 are cooperatively configured such that contact therebetween during a portion of an axle oscillation is substantially pure rolling contact.

It should be noted, from a frame of reference associated with support surface 150', that the instantaneous theoretical pivot axis 186 disposed at a max-right turn configuration is parallel to the theoretical pivot axis disposed at a max-left turn configuration. That is, in the max-right turn configuration, the line contact 186 is disposed in a mirror image on the other side of cage 140 compared to FIG. 8. A location of theoretical pivot axis 186 is displaced along the axle's length direction by an increasingly larger amount as axle 130 oscillates from a midrange turn configuration toward a maximum turn configuration. Also, the pivot axis 186 remains perpendicular to leg 136 during an entire axle oscillation cycle.

Load transfer into an axle 130 may be visualized with reference to FIGS. 4, 7, and 8. Assembly 104 is structured such that, during conventional use, well more than one-half of the total load carried by axle 130 is applied by the support surface of cam 142 to axle 130 (essentially by contact therebetween), and such contact is disposed substantially at theoretical pivot axis location 186. It is recognized that there is a little bit of load transfer from anchor flange 132 to hanger 128 due to friction and the steering angle γ. However, the applied load normal to flange leg 136 is a sine function of a small angle, and the friction load is believed to be negligible in the illustrated embodiment. Further, lubricant may be applied to further reduce the friction on hanger 128. This load transfer arrangement distinguishes embodiments structured according to certain principles of the instant invention over certain prior art, such as commercially available skateboard trucks having a kingpin and a pivot nose or shaft.

One consequence of structure arranged according to certain principles of operation of the instant invention is that the rider's effective load F, applied perpendicular to, and along the mid-span centerline of the deck 102, causes a return moment effective to urge the skateboard 100 toward a zero-turn configuration. In contrast, a similarly applied load generates zero moment in embodiments structured according to U.S. Pat. No. 5,971,411 to Jones et al. Similarly, such an applied load acts through the pivot axis of conventional skateboard trucks having a kingpin, a pivot nose, and compressible spring elements. Consequently, it is believed that no returning force moment is generated by such applied load in those exemplary devices. Essentially all of the return moment in such devices is generated in their spring elements. While spring elements may also contribute to the return moment in certain embodiments of the instant invention, the perpendicular mid-span applied load causes a significant portion of such return moment. Further, the force vector F is applied at a distance from pivot axis 186, which provides a moment arm that amplifies the rider's input. Also, damping inherent in certain rubber suspension elements according to U.S. Pat. No. 5,263,725 to Gesmer et al., is generally small in embodiments structured according to the instant invention, compared to certain available devices. Therefore, embodiments structured according to certain principles of the invention are believed to be more responsive to a rider's input to come out of a turn than any commercially available embodiment.

As detailed in FIGS. 9-12, truck assemblies 122 and 124 of embodiment 120 are structured according to the same general principles of operation as truck assemblies 104 and 106 of embodiment 100. Representative truck assembly 122 includes an axle hanger 190 disposed for its oscillation between parallel walls provided by front flange 192 and rear flange 194. Hanger 190 carries axle 130 to dispose wheels 110 in steerable relation relative to deck 102'. Front flange 192 and rear flange 194 may be provided as separate elements, as illustrated, or may be portions provided by a unitary part. The front flange 192 and rear flange 194 are typically affixed to deck 102' by conventional fasteners (not illustrated).

Hanger 190 may be maintained in oscillating registration between front and rear walls by retention bolt 196 and its cooperating nut 198. It is within contemplation that one or more spring element (not illustrated) may also (or alternatively to retention bolt 196 and nut 198), be included in certain embodiments of the invention and be structured effective to urge axle 130 toward a zero-turn configuration. A working surface 200 associated with axle 130 desirably makes pure rolling contact with support surface 202 of cam element 204. Preferred embodiments of cam 204 include a sweet spot at a neutral zone having a length "D" to promote stability at speed in a straight line of travel, similar to embodiment 100. In some embodiments, an additional resilient element may be included, similar to meniscus 148 in FIG. 6. However, it is currently preferred to provide a workable resilient element in the form of a resilient cam element 204 that is made from a resilient material, such as rubber, silicone, or urethane, or the like.

Figure 13:
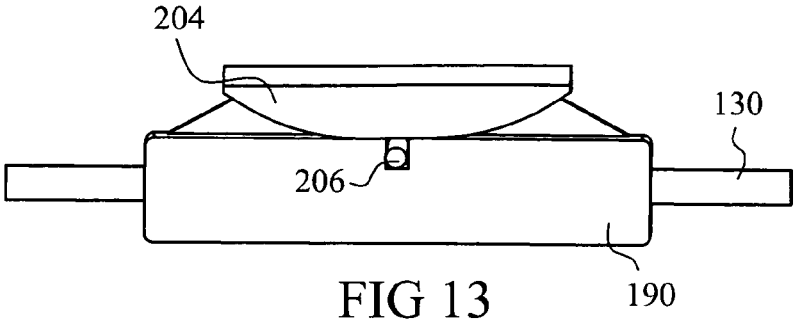
FIG. 13 is a front view in elevation of certain working components of the embodiment of FIG. 2, illustrated in a zero-turn configuration.
Figure 14:
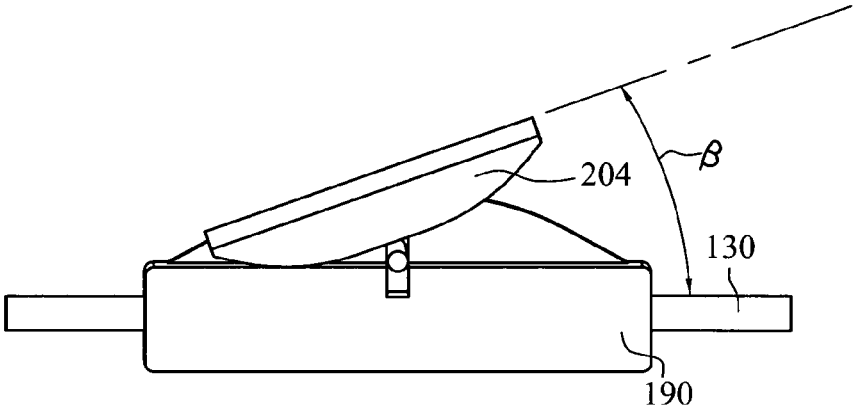
FIG. 14 is a front view in elevation of certain working components of the embodiment of FIG. 2, illustrated in an intermediate-turn configuration.
Figure 15:
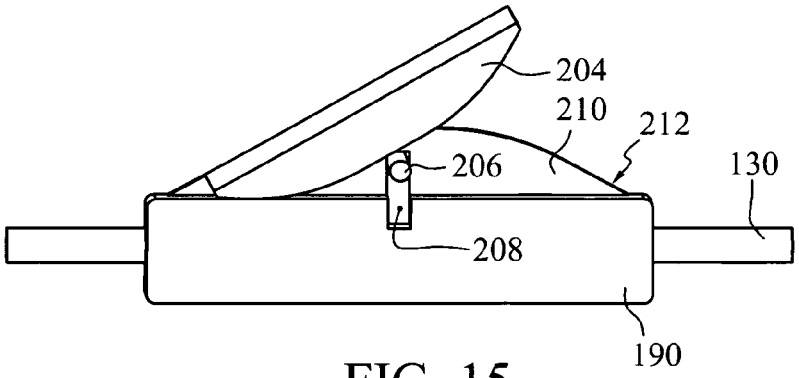
FIG. 15 is a front view in elevation of certain working components of the embodiment of FIG. 2, illustrated in a max-turn configuration.

As detailed in FIGS. 13-15, the hanger 190 is desirably configured in harmony with retention bolt 196 to make rolling contact along support surface 202 of support cam 204. Retention bolt 196 is essentially fixed in space by its association with front flange 192 and rear flange 194. Therefore, the position of penetrating shaft 206 of bolt 196 relative to cam 204 is desirably arranged to permit sliding of shaft 206 within slot 208 while permitting the desired rolling contact between working surface 200 and support surface 202. That is, the curved profile of support surface 202 is desirably configured in harmony with working surface 200 such that shaft 206 simply slides along slot 208 without generating a significant transverse load against the walls of the slot 208. An extension flange 210 may be provided to hold slot 208. Desirably, the edge 212 is structured to be spaced apart from contact with deck 102' (or other structure), to facilitate the desired rolling contact between support surface 202 and working surface 200.

Figure 16:
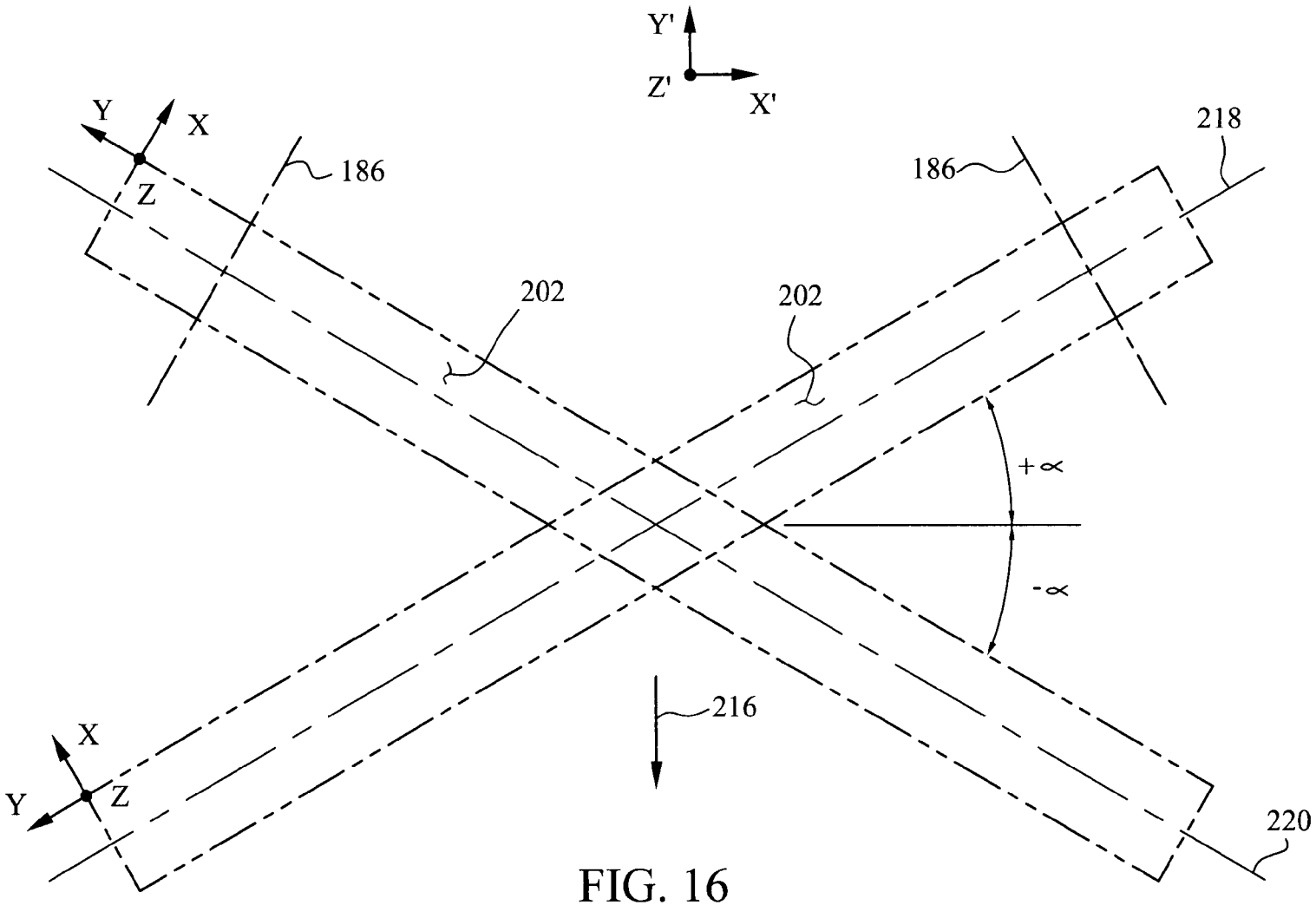
FIG. 16 is a composite plan view illustrating a support surface at both max-left turn and max-right turn configurations.

FIG. 16 illustrates a plan view looking at the support surface 202 of an embodiment structured according to certain principles of the instant invention. The direction of travel of the skateboard (or conveyance) is indicated at 216. The length axis of an axle 130 in a max-left turn configuration is indicated at 218. The length axis of an axle 130 in a max-right turn configuration is indicated at 220. The associated maximum turning angles are $\pm\alpha$, as illustrated. As previously indicated, $+\alpha$ does not necessarily have the same numeric value as $-\alpha$. The illustrated x,y,z coordinate system is relative to the support surface 202, and/or a flange wall, such as leg 136 or flange 192. The illustrated x',y',z' coordinate system is a global coordinate system, for example, in which the rider of a skateboard exists. It can be seen that theoretical pivot axis 186 remains parallel between max left- and max-right turn configurations. Also, theoretical pivot axis 186 remains perpendicular to a front wall portion 192 at both of the max-left turn configuration and the max-right turn configuration.

It is preferred to make a hanger 190 from a plastic, or plastic-like material exhibiting good wear resistance. An exemplary such material is Delrin™. However, it is within contemplation to make a hanger from a castable metal material, such as Aluminum. A meniscus 148 may be made from a rubber, or rubber-like material, such as polyurethane, having a durometer of about 50. An axle 130 is typically made from steel, although other materials are workable. Similarly, bolts, pins, and related fasteners may be of conventional construction, including steel, or stainless-steel, hardware. A preferred support cam is currently made from Delrin™, although other workable materials include urethane formulations or neoprene having a durometer of about 70. Flanges may be made from metal, including steel and Aluminum, or other structurally suitable materials.

Figure 3:
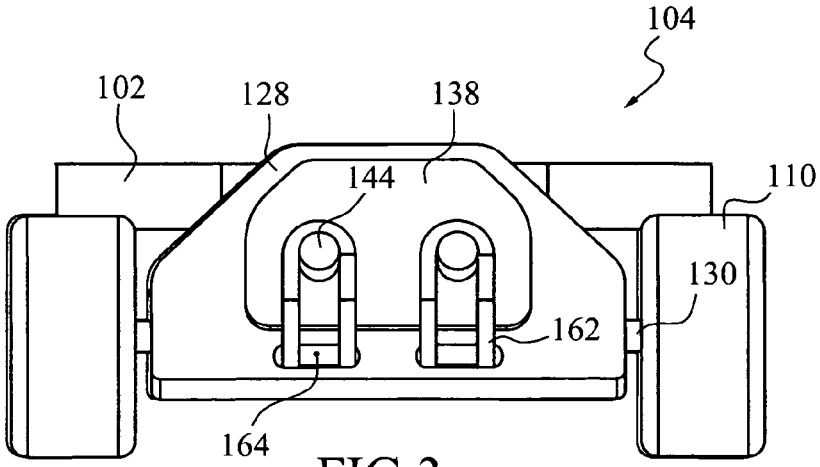
FIG. 3 is a front view in elevation of the embodiment illustrated in FIG. 1.

In accordance with a conventional patent disclosure, certain details of construction are omitted for reasonable brevity of this document. In certain cases, liberty has been taken with structure illustrated in certain FIGs. for clarity of assembly. For example, one of ordinary skill in the art will inherently know that bolts 144 and nuts 146 will include cooperating threads, which are not illustrated. Assembly of a bolt and nut is old in the art, and does not constitute a portion of the instant invention. Also, in a use-configuration, retainers (typically nuts), would be engaged on axle 130 to hold a wheel 110 in fixed association against an in-board stop. In such case, the axle 130 would typically not be visible as illustrated in FIG. 3. However, one of ordinary skill would naturally know that such discrepancy is for purpose of illustration, only. Such ancillary details are believed to be irrelevant to full and enabling disclosure of the instant invention.

While the invention has been described in particular with reference to certain illustrated embodiments, such is not intended to limit the scope of the invention. The present invention may be embodied in other specific forms without departing from its spirit or essential characteristics. The described embodiments are to be considered as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus, comprising:

an axle;

mounting structure effective to couple said axle to a conveyance, a portion of said mounting structure being configured and arranged to permit oscillation of said axle in substantially a single plane; and a support surface having an area with a profile configured and arranged to variably contact a working surface associated with said axle as said axle oscillates such that a location of a theoretical pivot axis, about which axis said axle instantaneously rotates with respect to said mounting structure;

is disposed at a locus of substantially line contact between said support surface and said working surface during a portion of an axle oscillation cycle;

from a local frame of reference with respect to said support surface, is displaced back and forth in a direction generally parallel to a length axis of said axle during said axle oscillation cycle; and wherein, from said local frame of reference, said instantaneous theoretical pivot axis disposed at a max-right turn configuration is parallel to said theoretical pivot axis disposed at a max-left turn configuration.

2. The apparatus according to claim 1, wherein:

said location of said theoretical pivot axis is displaced in said length axis direction by an increasingly larger amount as said axle oscillates from a midrange turn configuration toward a maximum turn configuration.

3. The apparatus according to claim 1, wherein:

said support surface and said working surface are cooperatively configured such that contact there-between during a portion of an axle oscillation is substantially pure rolling contact.

4. The apparatus according to claim 1, wherein:

said apparatus is structured such that, during conventional use, more than one-half of the total load carried by said axle is applied by said support surface to said axle by contact there-between, said contact being disposed substantially at said pivot axis location.

5. The apparatus according to claim 1, wherein:

said mounting structure comprises:

a planar front wall portion; and a planar rear wall portion disposed parallel to, and spaced apart from, said front wall portion sufficiently to receive a portion of said axle there-between.

6. The apparatus according to claim 5, wherein:

a steering angle formed between a plane disposed parallel to said front wall portion and a plane perpendicular to a transport surface is between about 5 degrees and about 50 degrees.

7. The apparatus according to claim 6, wherein:

said steering angle is between about 15 degrees and about 30 degrees.

8. The apparatus according to claim 5, wherein:

said theoretical pivot axis is disposed substantially perpendicular to said front wall portion at a zero-turn configuration of said apparatus.

9. The apparatus according to claim 5, wherein:

said theoretical pivot axis is substantially perpendicular to said front wall portion at both of said max-left turn configuration and said max-right turn configuration.

10. The apparatus according to claim 5, wherein:

said axle is maintained in trapped registration with respect to said mounting structure by a pin member that is anchored with respect to at least one of said front wall portion and said rear wall portion and has a portion disposed in sliding registration inside an elongate slot carried by said axle.

11. The apparatus according to claim 10, wherein:

said pin member and said elongate slot are cooperatively arranged to resist axle oscillation beyond a desired maximum value.

12. The apparatus according to claim 5, wherein:

said axle is maintained in trapped registration with respect to said mounting structure by confinement of said cam inside a cage.

13. The apparatus according to claim 12, wherein:

said cam and said cage are cooperatively configured and arranged to resist axle oscillation beyond a desired maximum value.

14. The apparatus according to claim 1, wherein:

said support surface comprises:

a portion of a cam having a left turn profile, a right turn profile, and a neutral zone disposed there-between, said neutral zone being associated with a zero-turn configuration.

15. The apparatus according to claim 14, wherein:

said neutral zone is structured in harmony with said working surface effective to provide initial resistance to oscillation of said axle away from said zero-turn configuration.

16. The apparatus according to claim 14, wherein:

said neutral zone comprises structure configured to simultaneously contact said working surface at two locations that are spaced apart along said length axis of said axle.

17. The apparatus according to claim 14, wherein:

one of said left turn profile and said right turn profile comprises an arcuate surface.

18. The apparatus according to claim 17, wherein:

a portion of said arcuate surface is defined by a radius having a length of between about 1½ inches and about 3½ inches.

19. The apparatus according to claim 18, wherein:

said radius has a constant value over a transverse length of said arcuate surface.

20. A skateboard truck of the type adapted to anchor an axle carrying a pair of wheels in operable association with a skateboard deck and effective to cause steerable movement of the axle responsive to rotation of the deck about a deck length-axis, the truck including a suspension arrangement configured to resist relative oscillation of the axle in an out-of-plane direction and to permit in-plane oscillation of the axle within a desired range, the improvement comprising:

said suspension arrangement being configured and arranged such that a force applied normal to said deck and along a mid-deck length axis, when said deck is rotated to a maximum turn configuration, causes a return moment effective to urge said deck toward a no-turn configuration; and said suspension arrangement being configured and arranged such that displacement, from a mid-range turn configuration toward a max-turn configuration, causes substantially pure rolling line contact to be formed between a load-bearing surface associated with said axle and a load-supporting surface that may be anchored with respect to a deck of said skateboard.

21. A skateboard truck of the type adapted to anchor an axle carrying a pair of wheels in operable association with a skateboard deck, the truck including a suspension arrangement configured to resist oscillation of the axle in an out-of-plane direction and to permit in-plane oscillation of the axle within a desired range effective to cause steerable movement of the axle responsive to rotation of the deck relative to the axle and about a deck length-axis, the improvement comprising:

a support surface associated with said deck and a cooperating working surface associated with said axle, a reaction force being generated at a location of contact between said support surface and said working surface responsive to rider weight, said location of contact changing from an essentially mid-axle position by an offset distance, in a direction along an axle length axis, responsive to rotation of said deck;

said support surface and said working surface being configured and arranged in harmony such that, when said deck is rotated about said deck length-axis from a no-turn configuration, a rider force applied normal to said deck and along a mid-deck length axis forms a force couple with said reaction force, thereby causing a return moment effective to urge said deck toward said no-turn configuration.

22. The skateboard truck according to claim 21, wherein:

at least one of said support surface and said working surface comprises an arcuate shape structured to form a rolling line contact with the other of said support surface and said working surface, said reaction force being applied at a location of said rolling line contact.

23. The skateboard truck according to claim 21, wherein:

an increase in rotation of said deck relative to said axle causes an increase in said offset distance and a correspondingly larger return moment.

* * * * *